US005288196A

United States Patent [19]

Horning et al.

[11] Patent Number: 5,288,196

[45] Date of Patent: Feb. 22, 1994

[54] COLLECTING, HAULING AND DELIVERING APPARATUS AND METHOD

[75] Inventors: Larry D. Horning, Crestline; Eugene R. Grubaugh, Galion; Thomas E. Pfeifer, Galion; Carroll R. Johnson, Galion, all of Ohio

[73] Assignee: Galion Holding Company, Galion, Ohio

[21] Appl. No.: 886,439

[22] Filed: May 20, 1992

Related U.S. Application Data

[63] Continuation-in-part of Ser. No. 565,172, Aug. 8, 1990, which is a continuation-in-part of Ser. No. 389,626, Aug. 4, 1989, abandoned.

[51] Int. Cl.[5] ..... B65F 3/04; B65F 3/14

[52] U.S. Cl. ..... 414/407; 414/408; 414/409; 414/410; 414/487; 414/512; 414/525.6

[58] Field of Search ..... 414/406–410, 414/487, 510, 525.2, 525.55, 525.6, 517, 509, 512

[56] References Cited

U.S. PATENT DOCUMENTS

| | | | |
|---|---|---|---|
| 1,180,292 | 4/1916 | Harris | 414/407 X |
| 3,083,849 | 4/1963 | Mottin | 414/407 X |
| 3,709,388 | 1/1973 | Neufeldt | 414/525.2 X |
| 3,865,260 | 2/1975 | Wieschel et al. | 414/517 |
| 4,113,125 | 9/1978 | Schiller | 414/406 |
| 4,372,726 | 2/1983 | Lutz | 414/517 |
| 4,425,070 | 1/1984 | Howells et al. | 414/498 |
| 4,840,531 | 6/1989 | Dinneen | 414/409 |
| 4,915,570 | 4/1990 | Rath et al. | 414/487 X |
| 4,978,271 | 12/1990 | Seader | 414/487 |
| 4,981,411 | 1/1991 | Ramsey | 414/487 |
| 5,035,563 | 7/1991 | Mezey | 414/525.6 X |
| 5,035,564 | 7/1991 | Matsumoto | 414/487 X |
| 5,074,737 | 12/1991 | Pellegrini et al. | 414/406 |
| 5,078,567 | 1/1992 | Lombardo | 414/525.6 |
| 5,094,582 | 3/1992 | Molzhon | 414/406 |
| 5,116,184 | 5/1992 | Pellegrini | 414/406 |

FOREIGN PATENT DOCUMENTS

| | | | |
|---|---|---|---|
| 0314238 | 5/1989 | European Pat. Off. | 414/406 |
| 3434581 | 4/1986 | Fed. Rep. of Germany | 414/525.55 |
| 3537546 | 4/1987 | Fed. Rep. of Germany | 414/409 |

*Primary Examiner*—Michael S. Huppert
*Assistant Examiner*—James Keenan
*Attorney, Agent, or Firm*—Niro, Scavone, Haller & Niro

[57] ABSTRACT

An apparatus for collecting and transporting recyclable waste material which includes a body for receiving material mountable to a vehicle. The body has separate upper and lower material-receiving compartments. Two longitudinally-spaced loaded openings are at the top of the body One opening is in continuous communication with only the lower compartment, and the second opening, positioned rearward of the first opening, is in continuous communication with only the upper compartment. Separate doors close the rear of each compartment; the second door, when closed, overlies and is spaced from the first door. A bucket, associated with the front of the body, can be raised, lowered and tipped, and has separate bins for receiving material. The bins are aligned with the loaded openings when the bucket is in the tipped, discharge position so that each bin can dump material into a corresponding compartment. Extendable and rectractable compactors are also employed for compacting and moving material within each of the two compartments.

23 Claims, 3 Drawing Sheets

COLLECTING, HAULING AND DELIVERING APPARATUS AND METHOD

This application is a continuation-in-part of copending Ser. No. 07/565,172, filed Aug. 8, 1990, which is in turn a continuation-in-part of Ser. No. 07/389,626, filed Aug. 4, 1989 (abandoned).

FIELD OF THE INVENTION

This invention relates to collecting, hauling and delivering apparatus for recyclable materials, and specifically to an improved vehicle body for collecting, hauling and delivering recyclable materials, which body includes multiple compartments for receiving and discharging different recyclable materials while segregating these materials from each other. The present invention is an improvement of apparatus and devices found in the prior art, including the vehicle shown in commonly assigned Ser. No. 565,172 and incorporated by reference herein.

BACKGROUND OF THE INVENTION

Numerous types of apparatus and vehicles for hauling both waste and recyclable materials are well known, as disclosed in the following: U.S. Pat. Nos. 4,425,070; 4,480,531; 4,915,570; 1,180,292; 1,650,249; 2,454,101; 2,592,324; 3,520,428; 4,273,497; 4,538,951; 4,552,500; 4,597,710; 3,865,260; 4,113,125; and 3,083,849. In addition, a variety of waste and recyclable material collecting and hauling apparatus is shown in the following foreign patent documents: Great Britain 263,726 and 670,253; Germany 206,781 and 3,537,546; EPO 314,238; and Canadian 1,264,702.

Generally, devices and vehicles intended to collect and haul waste or garbage are not suitable for collecting and hauling recyclable materials. Waste collecting and hauling devices and vehicles typically contain a single volume or compartment in which all collected materials are contained. It is generally desirable when collecting and hauling recyclable materials to maintain different materials in different compartments, although at times, it is acceptable to commingle some recyclable materials. For example, depending on local practices, it is often acceptable to commingle glass, plastic and aluminum recyclable materials with each other, but to segregate those three materials from paper and newsprint. Thus, a waste or garbage collecter which loads its single compartment with collected materials from a single bucket through a single opening at or near the top of the compartment is generally unsuitable for collecting recyclable materials.

Where special vehicles for collecting recyclable materials are used, they typically have two or more separated volumes or compartments into each of which specific recyclable materials are placed. In theory, vehicles for collecting recyclable materials could have one compartment for each type of recyclable material. For example, where the recyclable materials being collected include glass, plastic, aluminum and paper, the vehicle could contain four compartments each filled through a top opening by an associated bucket, or by a single bucket divided into separated bins, with one bucket or bin being associated with each compartment. See, for example, German patent application 3,537,546, and U.S. Pat. Nos. 4,840,531 and 4,113,125, as well as European patent 314,238.

Commonly assigned '172 application, referred to above, represents an attempt to provide a recyclable material collecter and hauler which is simple and efficient to operate, which minimizes worker effort and which renders the collection of recyclable materials efficient and expeditious. The invention of the '172 application includes a body carried by a vehicle frame. The body is separated into two interior compartments by an interior wall. One class of recyclable materials is intended to be placed in one compartment while a second class of recyclable materials is intended to be placed in the other compartment. A side-loading bucket is located near the front of the body and close to the egress and ingress points of the vehicle's cab. The bucket is vertically movable along a lateral side of the body f rom a lower loading position to an upper dumping position whereat material within the bucket is dumped through openings at the top of the body and into the compartments. In preferred embodiments, the bucket is divided into separated bins by a wall. When the bucket reaches the dumping position at the upper point of its travel, it is tilted to align the bins with the openings, which are longitudinally spaced at the top of the body, to thereby dump the recyclable materials in each bin through the openings and into the compartments. In its lower loading position, the bucket is conveniently located low to the ground and, as noted, close to the cab of the vehicle so that it may be easily, quickly and efficiently loaded with recyclable material by workers who ride in the vehicle's cab or on the outside thereof.

The bucket of the '172 application is located and vertically moves within a recess formed in the body. This construction permits the bucket to have only three sidewalls and a bottom wall, with the exterior, lateral sidewall of the recess forming or acting as the fourth or back sidewall of the bucket. The absence of the fourth sidewall from the bucket permits the bucket to be minimally rotated at the upper dumping position for expeditious dumping of materials into the compartments. Thus, the low loading height and location of the bucket lead to convenient filling thereof the lack of a back wall of the bucket within the recess leads to low spillage and minimizes wind-caused scattering of the contents thereof.

In the '172 application, a hoist mechanism raises and lowers the bucket, and, in response to bucket travel upwardly and downwardly, doors on the top of the body open and close the openings.

While the hoist for raising and lowering the bucket of the '172 application is generally satisfactory from an operational standpoint, it has been determined that its operation could be simplified and its cost could be lowered.

Each compartment in the device of the '172 application contains a compactor or packing blade for compacting materials therein. In preferred embodiments the packing blades operate alternately so that when one is extended and compacting the other is retracted and not compacting.

In many communities today where recyclable materials are collected and later processed it is recognized that glass, aluminum and plastic waste may be commingled, but, as commingled, must be kept separate from paper such as newsprint. It is believed by many that it is far less expensive to sort glass, plastic and aluminum recyclable materials at a central collection location or recycling center than it is to do so during the collection process.

Where glass is commingled with other materials, it has been determined that it is generally desirable to minimize the breakage thereof so that what is ultimately deposited at a central collection location or recycling center has minimal broken glass therein. This minimization of glass breakage requires a consideration of both the ramifications of compacting the commingled materials within the body and what occurs at the time the commingled materials are placed into their respective compartments and dumped from these compartments. Similar attention, it has been determined, must be paid to segregating the commingled materials from paper and newsprint during both loading operations and dumping operations.

An additional consideration regarding plastic-containing materials is so-called "plastic springback." This phrase refers to the tendency of plastic, once compacted, to spring back to its original volume as the compacting force is removed. Should this occur after commingled materials are placed in a compartment of a collecting and hauling vehicle, it may be difficult or impossible to add additional commingled materials to the compartment—the relevant opening thereof may be blocked or partially blocked or the compartment may be "filled" with uncompacted plastic—without reinstituting compaction. This step requires time and slows down the material collection process.

A primary object of the present invention is the general improvement of the recyclable material collecting and hauling vehicle shown in the '172 application, as well as the provision of solutions for the above noted and other problems and the avoidance of shortcomings found in numerous prior art collecting and hauling vehicles.

SUMMARY OF THE INVENTION

With the above and other objects in view, the present invention generally relates to apparatus for collecting recycling material. The apparatus includes a truck body which is mountable to a truck frame and which longitudinally extends between a forward end and a rearward end to enclose a material-receiving volume. A horizontal wall within the volume divides it into separated upper and lower material-receiving compartments.

Longitudinally spaced loading openings at the top of the body are each in continuous communication with one of the compartments, and a bucket is vertically movable along the exterior of the body between a lower loading position at the bottom of the body and an elevated discharge position at the top of the body. The bucket has separated bins for receiving material. Each bin is aligned with one of the openings when the bucket is in the discharge position to dump material into one of the compartments via its loading opening.

A cover normally closes or blocks the openings. Facilities selectively open the cover. Selective opening of the cover is effective to move the bucket from the loading position to the discharge position. The cover-opening facilities also selectively close the cover, and, in response thereto, the bucket is moved from the discharge position to the loading position.

In preferred embodiments the upper compartment receives commingled glass, plastic and aluminum materials from one bin of the bucket via one loading opening, while the lower compartment receives paper materials from the other bin via the other loading opening. Because the commingled materials fall a relatively short distance from the bucket into the upper compartment and onto the horizontal wall, glass breakage is reduced.

The apparatus includes facilities for pivotally mounting the body to the frame near the rear of both thereof. In this way, upward pivoting of the front portion of the body occurs simultaneously with a downward pivoting of the rear portion of the body. The pivot location is such that the lower rear portion of the body is positioned near the ground. There is a rear dumping opening in the body for discharging materials from the upper compartments when the lower rear portion of the body is near the ground. Accordingly, breakage of glass being dumped from the upper compartment is reduced by virtue of the short distance that the commingled materials fail from the dumping opening onto the ground.

A first door normally closes the rear of the lower compartment. A second door normally closes the dumping opening of the body. When the first and second doors are closed, the second door overlies the first door and, the doors being spaced, a vertical continuation of the upper compartment is defined therebetween. In this way, the opening of the second door while the first door is kept closed permits emptying of the upper compartment only. Subsequently, the apparatus may be moved to another location whereat the first and second doors are opened thereby emptying the lower compartment via the dumping opening. Accordingly, the materials in the two compartments are not commingled during dumping. In preferred embodiments, both doors are bulged or bowed outwardly to maximize the interior volume of the compartments.

Generally speaking, it is preferred that the bucket move vertically in the body recess as in the '172 application. However, a simplified means for moving the bucket and opening the cover for the loading openings is provided.

Specifically, in the '172 application, the cover is opened and closed in response to upward or downward movement of the bucket. In the present invention, the bucket is moved up or down in response to opening or closing of the cover. More specifically, an opening and moving facility of the present invention includes a member, one end of which is pivotally mounted near the top of the body with its free end generally overlying the bucket. An idler roller is rotationally mounted on the free end of the pivotal member. A band, such as a chain, passes over the idler roller and has a first free end attached to the bucket and its second free end attached to the top of the body. Facilities selectively rotate the pivotal member. The member may be rotated upwardly and then inwardly of the body to increase the amount of the band located between the second free end and the idler roller and to shorten the amount of the belt between its first free end and the idler roller to thereby move the bucket from its lower to its elevated position. Similarly, the pivotal member may be rotated outwardly and then downwardly to shorten the amount of belt located between the belt's second free end and the idler roller and to increase the amount of the belt between its first free end and the idler, thereby moving the bucket from its elevated to its lower position. In preferred embodiments, the pivotal member is a part of or is integral with the cover for the loading openings so that uncovering them initiates raising of the bucket.

Each compartment preferably includes facilities for compacting materials therein. These compacting facilities apply rearwardly directed force to materials within the separated compartments toward and against the closed discharge doors. Preferably, as in the '172 application, facilities operate the compacting facilities so that when one of them applies compacting force to the materials in one of the compartments, the other compacting facility is retracted and does not apply compacting force to the material in its compartment. In preferred embodiments the compacting facility in the upper compartment normally applies force to the commingled materials therein. The substantial and prolonged periods of force application to the commingled materials of the upper compartment tend to eliminate or minimize plastic springback of the plastic materials. Also in preferred embodiments, the compacting facility in the upper compartment is extended and applies force to material in that compartment whenever the bucket is in its lower loading position, which is its normal position. The compacting facilities in the upper compartment are retracted only when the bucket is moved to the top of the body for dumping recyclable materials into the compartments.

Glass breakage is further minimized by a facility in the upper compartment which induce the glass to gravitate or move to the lower regions of the upper compartment as the compacting facility therein compacts the material. The encouraging facilities include a step with the lower portion of the step being rearward of the upper portion of the step. Due to the presence of this step, glass materials, which are denser than the plastic or aluminum materials, tend to fall below the less dense materials as the compacting facility moves the commingled materials over the step.

DETAILED DESCRIPTION

Figure 1:
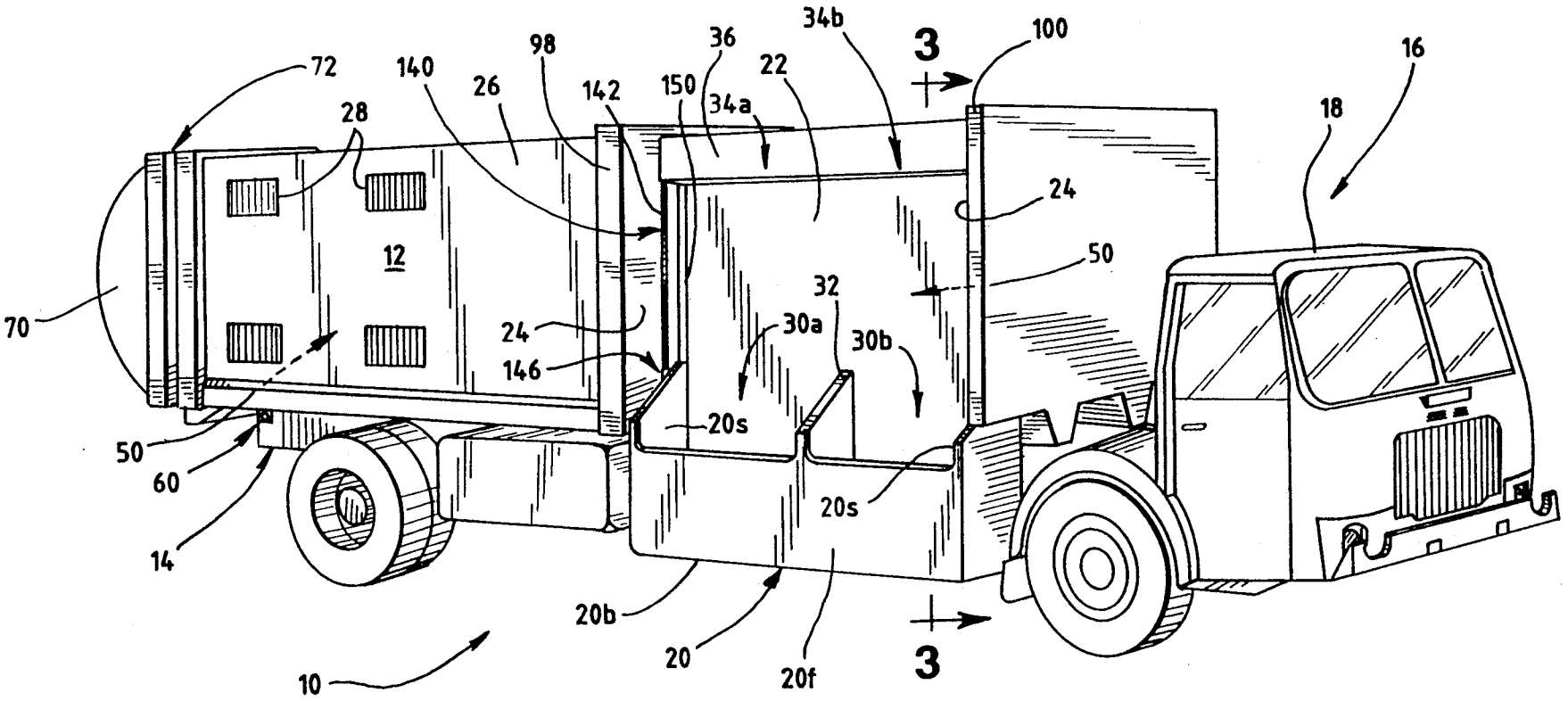
FIG. 1 is a perspective view of a recyclable material collecting, hauling and depositing vehicle according to the present invention.

Referring first to FIG. 1, apparatus 10 according to the present invention may be seen to include a body 12 carried by a frame 14 of a wheeled vehicle 16, which includes a cab 18 at the front of the frame 14, a typical power train (not shown), hydraulic facilities (not shown) such as piston-cylinders, electrical facilities (not shown) and hydraulic and electrical controls 19 therefor. This construction permits the body 12 to be mounted to a variety of vehicles 16, as desired by customers. The body 12 is typically made of metal and encloses an internal volume (not shown) for the containment of recyclable materials as described in more detail below. The body 12 includes certain features of the invention described in the '172 application and is an improvement thereof.

Associated with the body 12 is a bucket 20 which is moveable vertically up and down along a lateral wall 22 of the body 12 within a recess 24. The recess 24, which includes the lateral wall 22, is formed as a depression directed toward the center line of the body 12 with respect to a main lateral side wall 26 of the body 12 which extends from the recess 24 to the rear of the body 12. As explained in the '172 application, the bucket 20 preferably has two side walls 20*s*, a front wall 20*f* and a bottom wall 20*b*, but it does not have a rear wall facing or adjacent to the lateral body wall 22. The location of the bucket 20 towards the cab 18 at the front of the body 12 renders it conveniently located at a convenient height for the filling thereof with recyclable materials.

When it is desired to load the volume enclosed by the body 12 with materials in the bucket 20, bucket 20 is elevated within the recess 24. Near the top of the body 12, the bucket 20 is rotated or tipped. This tipping of the bucket 20 permits materials therein to be loaded into the body 12, with the bucket 20 rotating a minimal amount because of the lack of a rear wall. The movement of the bucket 20 within the recess 24 prevents the wind from blowing materials out of the bucket 20. The '172 application describes certain facilities for raising and lowering the bucket 20 and for tipping it. Although these facilities may be used, the present invention includes improved facilities for achieving these goals, as described below.

The main lateral side wall 26 of the body 12 may include one or more viewing ports 28. These viewing ports 28 are utilized to ascertain the extent of material loading, if materials have become jammed, or if other untoward conditions exist within the body 12.

In the preferred embodiment depleted in FIG. 1, the bucket 20 is divided into separated bins 30*a* and 30*b* by a wall 32. In one of the bins, for example the rearward bin 30*a*, there is placed commingled recyclable plastic, aluminum and glass. In the forward bin 30*b*, there is typically placed recyclable paper such as newsprint. Upon sufficient upward movement of the bucket 20, the bins 30 become aligned with respective loading openings 34*a* and 34*b* formed through the top of the body 12. This alignment is achieved by first effecting the opening of a cover 36 which is movably mounted to the top of the body 12 and which normally closes the loading openings 34. While one form of facility for opening the cover 36 is depleted in the '172 application, an alternate improved form thereof is disclosed herein in conjunction with the description of the facilities for raising and lowering the bucket 20.

Figure 2:
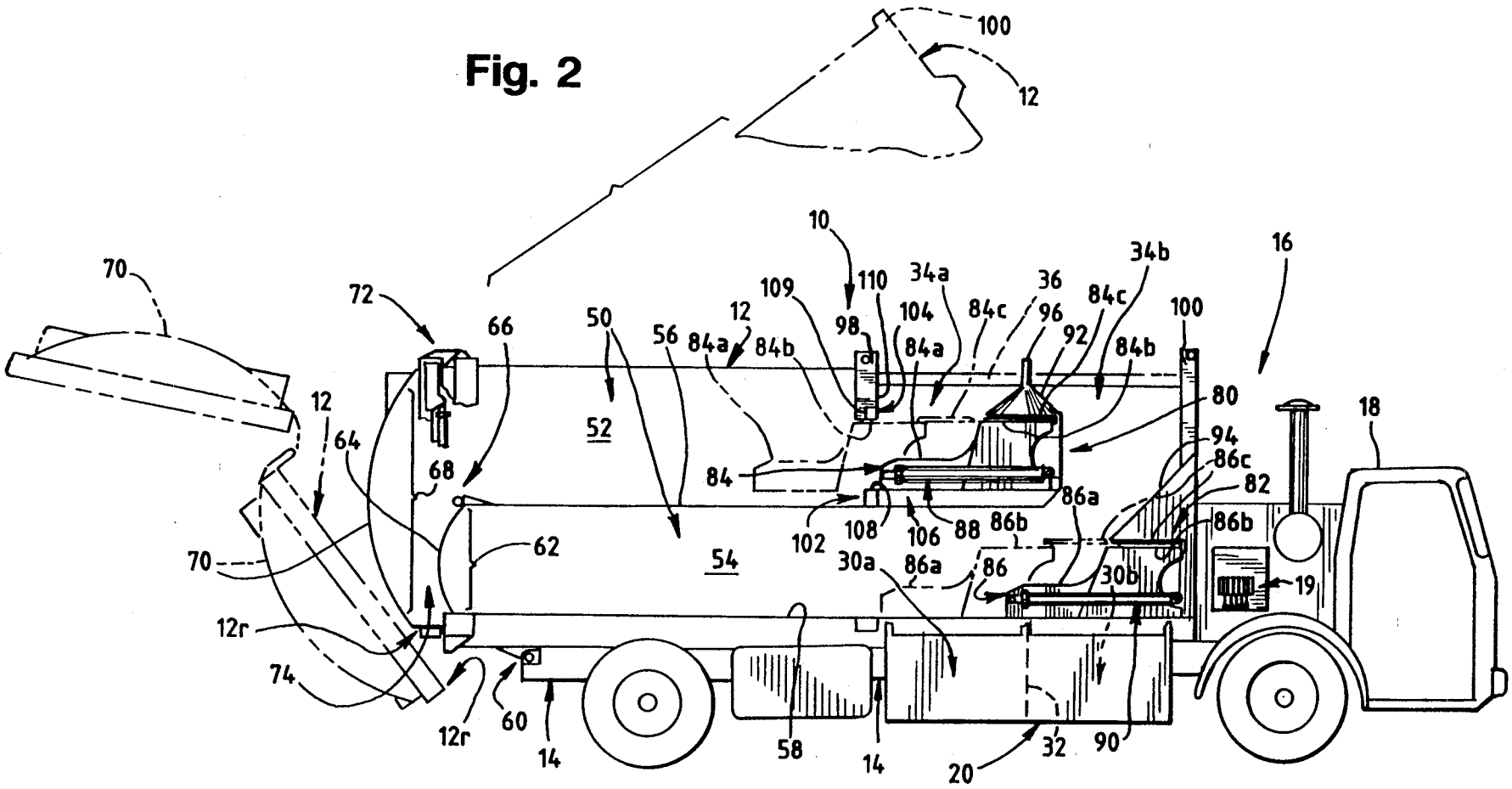
FIG. 2 is a schematic, partially sectioned side elevation of the vehicle shown in FIG. 1.

Referring now to FIG. 2, a schematic cutaway view of the body 12 is presented. As noted above, the body 12 defines and encloses an internal volume 50 for the receipt of recyclable materials. The volume 50 is divided into two compartments, an upper compartment 52 and a lower compartment 54. Typically, for reasons to be explained below, the upper compartment 52 is intended to contain commingled glass, plastic and aluminum, while the lower compartment 54 contains paper such as newsprint.

As may be seen, the loading openings 34*a* and 34*b* are longitudinally separated along the axis of the body 12 so that upon the bucket 20 being elevated and rotated to dump materials from the bins 30, the materials from the rear bin 30*a* will enter the rearward opening 34*a* to be deposited in the upper compartment 52 while material from the forward bin 30*b* will enter the forward opening 34*b* to enter the lower compartment 54. The compartments 52 and 54 are separated, and the materials therewithin are prevented from commingling, by a horizontal wall 56, which may be formed and mounted within the body 12 in any convenient fashion. The wall 56 forms a floor for the upper compartment 52. The bottom 58 of the body 12 forms a floor for the lower compartment 54.

The body 12 is pivoted on the frame 14 at a point, generally shown at 60, which is at the rear of the body 12. Facilities (not shown) such as a standard piston-cylinder (or other hydraulic or mechanical device) connected between the frame 14 and the body 12 are arranged to elevate the forward end of the body 12 by pivoting the body 12 on the pivot 60. Such pivoting rotates and lowers the rearward portion 12*y* of the body 12 toward the ground, as seen in phantom in FIG. 2.

The rear of the lower compartment 54 terminates in a dumping outlet 62 which is normally closed by a door 64. The door 64 may pivot as generally indicated at 66 to selectively uncover the dumping outlet 62.

The rear of the body 12 terminates in a dumping outlet 68 which is normally closed by a door 70. The door 70 is pivotal about a point generally designated 72 to selectively uncover the normally closed outlet 68. Both doors 64 and 70 are preferably bulged or bowed outwardly as shown to the rear of the body 12 with the door 70 normally overlying the door 64. There is defined between the doors 70 and 64 a volume 74 which generally comprises a rearward extension of the upper compartment 52 when the doors 64 and 70 are closed.

The upper compartment 52 includes compacting facilities generally designated 80, and the lower compartment 54 includes compacting facilities generally designated 82. The facilities 80 and 82 each include a movable ram or blade 84 and 86 which may be selectively reciprocated toward the rear or the front of the body 12 by respective piston-cylinders 88 and 90 selectively operable by the hydraulic and/or electric controls 19 typically located between the bucket 20 and the cab 18. The rams 84 and 86 may comprise, in effect, a metal shell surrouding the piston-cylinders 88 and 90 and are made of various segments 84*a*, 84*b*, 84*c* and 86*a*, 86*b* and 86*c*. The compactors 80 and 82 also include covers or shields 92 and 94 which cover the rear portions of the piston-cylinders 88 and 90 to prevent materials entering the compartments 52 and 54 through the openings 34 from falling behind the compactors 80 and 82. The forward portions of the piston-cylinders 88 and 90 are protected from such materials by the rams or blades 84 and 86 which cover the front portions of the piston-cylinders 88 and 90. The rams 84, 86 and the covers 92, 94 are telescoped to this end. The cover 92 may include a projection 96 which spans the body 12 laterally and defines with frame members 98 and 100 the loading openings 34*a* and 34*b*.

In accordance with known techniques, the ram 84 of the compactor 80 in the upper compartment 52 is normally held in an extended position as shown to the left of Center in phantom in FIG. 2. In this extended position, commingled materials within the upper compartment 52 are maintained in an on-going compacted condition due to the application of force by the ram 84 toward the rear of the body 12 and the normally closed door 70 thereat. Initially, the application of such force first causes the rear mass of commingled materials within the compartment 52 to fall into the volume 74 defined between the doors 70 and 64. The loading of further commingled materials via the opening 34*a* into the upper compartment 52 and the compaction thereof by the compacter 80 ultimately effects the aforedescribed compaction.

While the ram 84 of the upper compactor 80 is normally extended, the ram 86 of the lower compacter 82 is normally retracted, as shown in solid lines in FIG. 2. The normal position of the rams 84 and 86 are achieved whenever the bucket 20 is in its normal lowermost position as shown in FIGS. 1 and 2. That is, while the vehicle 16 is driven and while the bucket 20 is being loaded, the upper ram 84 compacts the commingled mass of recyclable materials in the upper compartment 52 and the lower ram 86 is retracted. Since the mass of commingled material includes plastic, the normal extension of the compacter 80 prevents plastic springback from adversely affecting the operation of the apparatus 10.

Specifically, the normal application of force on the mass of recyclable materials in the compartment 52, which mass includes plastic, permits the periodic retraction of the ram 84 of the compacter 80 and the loading of additional commingled materials into the upper compartment 52 without having the plastic materials immediately spring back to their original size to thereby possibly block the opening 34*a*. As the bucket 20 moves from its lowermost (FIGS. 1 and 2) to its uppermost (FIG. 3) dumping position, the ram 84 retracts and the ram 86 extends to compact the paper materials within the lower compartment 54. The ram 84 thus clears the opening 34*a* for loading from the bucket 20. Having continuously compressed the plastic materials in the upper compartment 52, the lefthand opening 34*a* is at least momentarily clear of such plastic to receive additional commingled materials for loading into the upper compartment 52. When the bucket 20 has loaded whatever materials are contained in the bins 30 and begins to move downwardly, the rams 84 and 86 return to their normal positions, that is, the ram 84 is extended and the ram 86 is contracted.

Associated with the compactor 84 are a step 102 and a breaker bar 104. The step 102 is formed by a platform 106 on which the compactor 84 rests, the platform 106 having a surface 108 elevated above the wall 56 by about 4" to 6", although other elevations are contemplated. The step 102 may be located as shown or may be further to the rear of the upper compartment 52. The breaker bar 104 spans the width of the upper compartment and may include an elongated member 109 mounted to a plate 110, both being on or a part of the frame member 98. As shown in FIG. 2, the segment 84*b* of the compactor 84 closely clears the member 108 when the compactor 84 is extended.

Following the collection of recyclable materials, the vehicle 16 will return to a central processing location to be emptied of materials within the compartments 52 and 54. The preferred way of achieving this is now described. Facilities (not shown) are activated by the controls 19 to rotate the body 12 on the pivot 60. Other facilities are then operated by the controls 19 to first open the door 70 while the door 64 is maintained closed. In this way, comminged materials in the upper compartment 52 may be unloaded for subsequent separation. Once the upper compartment 52 is emptied, the vehicle 16 is moved to another location whereat, with the body 12 again (or still) rotated on the pivot 60, both doors 70 and 64 are opened, to thereby empty the lower compartment 54. It should be noted that the pivot 60 is located so that, as shown in phantom in FIG. 2, the bottom 12*r* of the opening 68 of the body 12 is quite close to the ground.

Several of the features described above minimize the breakage of glass which is present in the mass of commingled materials loaded into the upper compartment 52. First, glass breakage is minimized when commingled materials are dumped from the rear bin 30*a* of the bucket 20 through the rear opening 34*a* into the upper compartment 52. Since the materials are loaded from the bin 30 into the upper compartment, the distance they fall is quite short. Indeed the materials fall by stages first hitting the cover 92, then the segment 84*a*, then the surface 108 of the platform 106 and finally the wall 56. The short falling distance minimizes glass breakage as the commingled materials enter the upper compartment 52. Second, because the lower portion 12*r* of the opening 68 of the body 12 is located quite close to the ground when the body 12 have been rotated upwardly about the pivot point 60, materials discharged from the upper compartment 52 with the door 70 open fall only a short distance to the ground, again, thereby minimizing breakage of the glass components of the commingled materials. Third, the step 102 co-acts with the blade or ram 84 of the compacter 80 to induce and encourage glass contained within the mass of commingled materials to gravitate or move to the lowermost positions thereof. Specifically, as the blade or ram 84 moves the commingled material over the step 102, the denser glass tends to move, or gravitates, beneath the less dense plastic and aluminum. Fourth, the breaker bar may serve to induce or encourage the denser glass to move beneath and below the less dense plastic and aluminum as the ram 84 of the compacter 80 moves material within the upper compartment 52 rearwardly, although the breaker bar's primary function is to inhibit frontward movement of already compacted materials. Of course, as with the invention of the '172 application, breakage of glass is further discouraged by the convenient work-height-located bucket 20 so that commingled material placed into the left-hand compartment 30*a* is not likely to break.

When the commingled materials in the volume 74 of the upper compartment 52 are discharged, remnants of the former contents of the bottles, cans and other containers may spill onto the bottom 58 of the body 12 between the doors 64 and 70. The length of the bottom 58 is preferably minimized so that only a small initial amount of the paper materials discharged from the lower compartment contact these spilled contents.

Figure 3:
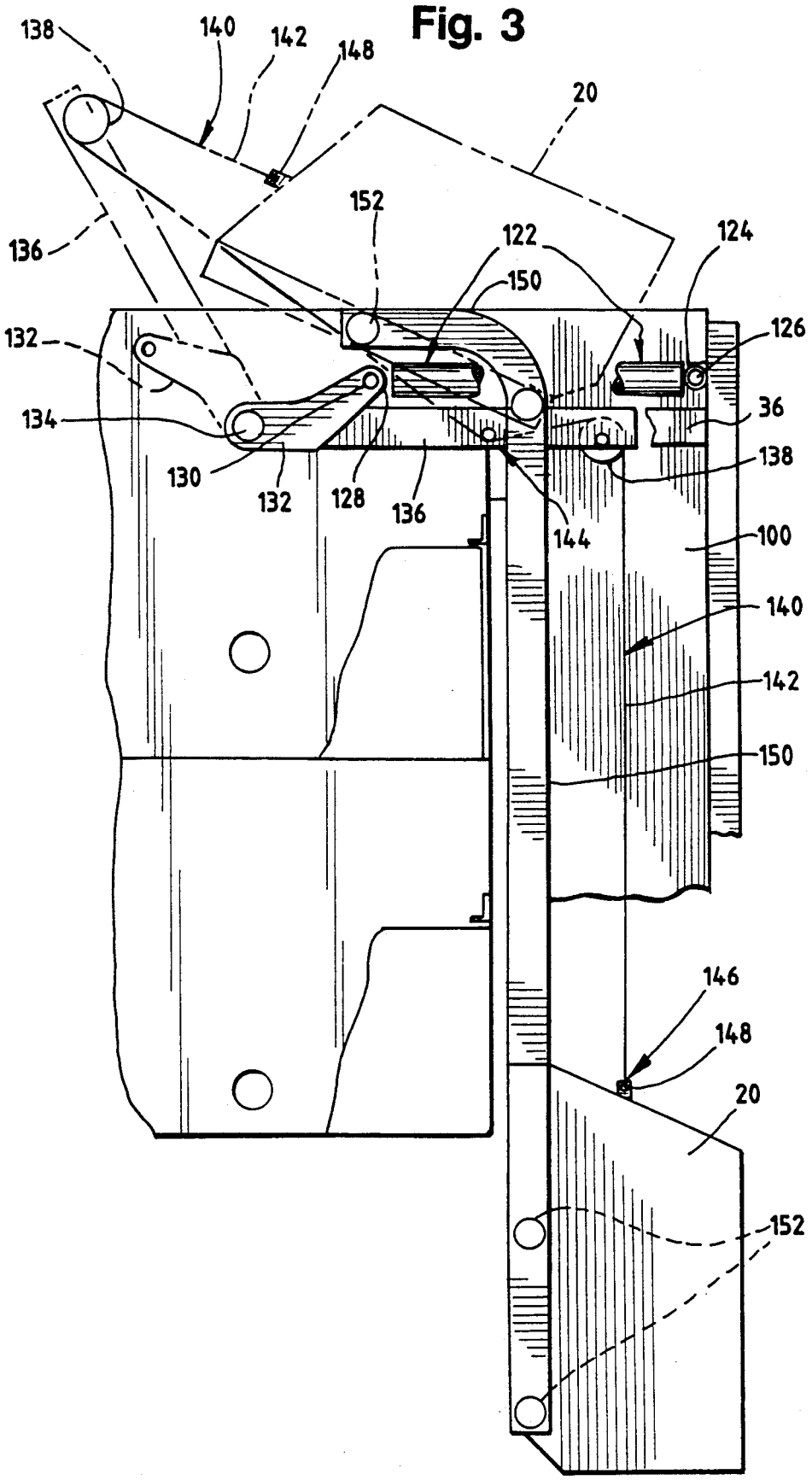
FIG. 3 is an elevation taken generally along line 3—3 of FIG. 1 showing a portion of a bucket-moving and cover-operating mechanism forming a portion of the vehicle of FIGS. 1 and 2.

Turning now to FIG. 3 which is a view taken generally along the line 3—3 in FIG. 1, there are shown the facilities 120 for moving the bucket 20 between its lower and elevated positions. As already noted, these facilities 120 are an improvement of those depicted in the commonly assigned '172 application.

The facilities 120 include a piston cylinder 122 which is selectively extendable and retractable by appropriate operation of the controls 19 which effect operation of appropriate hydraulic and other facilities (not shown). One portion of the piston cylinder 122 such as the cylinder end 124 may be pivotally mounted as generally shown at 126 to a rearward surface of the frame member 100 which defines the forward portion of the recess 24. Another portion of the piston cylinder 122 such as the piston end 128 is pivotally mounted as generally shown at 130 to an end of a crank arm 132. The other end of the crank arm 132 is mounted as by a stub shaft 134 or the like to an elongated member 136. The stub shaft 134 may be journaled at either end by facilities (not shown) which permit the crank arm 132 and the member 136 to rotate together. Such rotation is achieved by extending or retracting the piston cylinder 122. Extension of the piston cylinder 122 rotates the crank arm 132 counter clockwise as viewed in FIG. 3. Counter clockwise rotation of the crank arm 132 rotates the member 136 in a counter clockwise direction. Similarly, retraction of the piston cylinder 122 causes the crank arm 132 and the member 136 to rotate clockwise.

Near the end of the member 136 which is remote from the stub shaft 134 there is rotatably mounted an idler roller 138. The idler roller 138 rotates with the member 136. The member 136 is located near the frame member 100 and overlies a forward portion of the opening 34*b*.

A band 140, preferably in the form of a chain 142, passes over the idler roller 138. One end of the band 140 is mounted to the body 12 and may be mounted, for example, to the frame member 100 as generally shown at 144 and may be mounted to another structural member constituting the body 12. The other end of the band 140 is connected as at 146 to the bucket 120. The connection of the band 140 to the bucket 20 may be achieved by connecting the band 140 to a tab 148 mounted to or integral with the bucket 20.

In FIG. 3, the bucket 20 is shown in solid lines in its lower position as illustrated in FIGS. 1 and 2. In order to elevate the bucket 20, the piston cylinder 122 is extended to rotate the crank arm 132 counter clockwise. This rotation rotates the member 136 counter clockwise and accordingly, rotates the idler roller 138 counter clockwise. Rotation of the idler roller 138 counter clockwise increases the distance between the idler roller 138 and the connection 144 of the band 140 to the body 12. This distance increase increases the length of the band 140 extant between the idler roller 138 and the connection 144. This increase in band length effects a decrease in the length of the band between the idler roller 138 and the point of connection 146 between the band 140 and the bucket 20. The decrease in this length effects elevation of the bucket 20. Ultimately, the bucket 20 reaches its elevated position as shown in dotted lines in FIG. 3 whereby materials contained therein are loaded into the compartments 52 and 54 as described earlier. The bucket 20 may be returned from its elevated position to its lower position by retracting the piston cylinder 122.

In preferred embodiments, the member 136 forms a portion of or is integral with the cover 36. In this fashion, appropriate pressurization of the piston cylinder 122 to effect extension thereof opens the cover 36 in preparation for the dumping through the openings 34*a* and 34*b* of materials. The opening of the cover 36 due to the counter clockwise rotation of the idler roller 138 effects movement of the bucket 20 from its lower position to its elevated position. Thus, in the present invention the bucket 20 moves from its lower to its elevated position in response to opening of the cover 36.

As already noted, the bucket 20 lacks a back wall and accordingly, the minimal rotation thereof, as shown in FIG. 3, is sufficient to dump material from within the bucket 20 through the openings 34*a* and 34*b*. To achieve this rotation or tipping of the bucket 20, there is provided a track 150. The track 150 may take any known form and is preferably attached to the rear surface of the structural member 100. Rotatably mounted to the side 20*s* of the bucket 20 may be rollers or wheels 152 which ride in and are guided by the track 150. The track 150 generally conforms to and has a vertical run corresponding to the front corner of the recess 24. Near the top of the body 12, the track 150 becomes arcuate and then extends a short distance towards the center line of the body 12. As shown in FIG. 3, the relationship between the radius of the arc of the track 150 and the distance between the rollers 152 is selected so that when the bucket 20 reaches its elevated position, it is rotated or tipped as depicted in the figure to effect efficient dumping of material therewithin. As will be appreciated, another track similar to the track 150 is mounted to the forward surface of the structural member 98 and rollers similar to the rollers 152 on the rear sidewall 20*s* of the bucket 20 ride therein and are guided thereby. Similarly, a band 140, such as the chain 142 is connected to the bucket 20 at its rear sidewall 20*s* and passes over an idler roller 138 associated with a member 136 which is part of or connected to the rear portion of the cover 36. The two piston cylinders 122 involved in cover opening and bucket elevation are by any known technique operated in a unison of the other controls 19.

Various features of the above-described invention deserved to be emphasized. First, the longitudinal spacing of the openings 34*a* and 34*b* is important in that it permits materials to be loaded thereinto from a side mounted bucket 20 which can, as a consequence, be conveniently located close to the cab 18 of the vehicle 16. Second, the concept of raising and lowering the bucket 20 in response to movement of the cover 36 permits the simple mechanism described above to be utilized to that end. Third, the location of the openings 34 relative to the compartments 52 and 54 and to each, permits the openings 34 to be in continuous communication with only one of the compartments. As a result of this structure, no opening is used to load more than one compartment with materials and the need to use complicated trap door or similar structures in the bottom of each compartment to permit communication between an upper opening and a lower compartment is eliminated.

Fourth, the recess 24 and the body 12 permit the bucket 20 to be used without the presence of a backwall which leads to efficient dumping of material into the compartments 52 and 54. Further, this construction shields the bucket 20 within the recess 24 improving the profile aesthetics of the apparatus 10 and inhibiting wind blown materials from exiting the bucket 20. The location of the recess 24 toward the front of the body 12 and the near cab 18 coupled with the convenient location of the bucket 20 in its lower position leads to efficient use thereof by workers who are utilizing the vehicle 16.

Sixth, the use of the upper compartment for comingled glass, plastic and aluminum and the use of the lower compartment 54 for paper maintains the center of gravity of the body 12 low as it becomes filled. The paper materials, especially when compacted, are denser than the comingled materials in the upper compartment 52.

Seventh, the manner in which the body 12 is pivoted and in which the doors 64 and 70 are opened achieves several desirable goals. The proximity of the rearward portion 12 to the ground after the body 12 has been pivoted on the pivot 60 minimizes glass breakage as comingled materials leave the upper compartment 52. The use of the door-inside-door structure permits the comingled materials of the upper compartment 52 to be dumped first with the wall 56 and the closed lower door 64 preventing any contamination or mixing between such materials and those retained in the lower compartment 54. Moreover, the paper materials in the lower compartment 54 are, when dumped with the door 64 opened, exposed to little if any residual waste of the comingled materials dumped from the upper compartment 52.

Minimization of glass breakage is also achieved by the manner in which the comingled materials are loaded into the upper compartment 52 from the bucket 20. These materials fall a series of short distances in contact with the cover 92, the segment 84A of the ram 84, the step 102 and wall 56. AU of these elements as described previously cooperate to induce the more dense glass to move to lower positions within the mass of comingled materials so that upon dumping thereof with the door 70 open, their fall to the ground is further minimized.

Last, there has been described the alternate operation of the compacting facilities 80 and 82 so that when one is extended, the other is retracted. Further, there has been described a desirable operation of normally having the compacting facilities 80 extended to apply constant on-going pressure to the comingled materials in the upper compartment 52 and especially to the plastic materials contained therein. This constant force as explained earlier ameliorates or eliminates so-called plastic spring-back and its problems. Also described is the operation of the apparatus 10 in which with the bucket 20 in its normal lower position, the compacting facility 8 in the upper compartment 52 is extended and the compartmenting facility 82 in the lower compartment 54 is retracted. Further, there has been described that when the bucket 20 is elevated to load material through the openings 34A and 34B the compartmenting facility 80 retracts and the compartmenting facility 82 extends, both returning to their normal positions when the bucket 20 reassumes its lower position.

We claim:

1. An apparatus for collecting recyclable material, comprising:

(a) a truck body mountable to a truck frame and extending longitudinally between a forward end and a rearward end, the body enclosing a material-receiving volume;

(b) a horizontal wall within the volume which divides the volume into separate upper and lower material-recovering compartments;

(c) longitudinally-spaced loading opening at the top of the body, each opening being in continuous communication with only one of the compartments;

(d) a bucket vertically moveable adjacent the exterior lateral side of the body between a lower loading position at the bottom of the body and an elevated discharge position at the top of the body, the bucket having separated bins for receiving material, each bin being aligned with one of the openings when the bucket is in the discharge position to dump material into one of the compartments;

(e) a cover normally closing the loading openings; and (f) means (i) for opening the cover and for moving the bucket from the loading position to the discharge position in response to such opening, and (ii) for closing the cover and moving the bucket from the discharge position to the loading position in response to such closing, the opening/moving and closing/moving means comprising (1) a pivoted member having one end pivotally mounted near the top of the body inwardly of the lateral body side along which the bucket moves and a free end generally overlying the bucket, (2) an idler roller rotationally mounted on the free end of the member, (3) a band member passing over the idler roller and having a first free end attached to the bucket and a second free end attached to the body near the top thereof generally co-planarly with the lateral body side along which the bucket moves, and (4) means for selectively rotating the pivotal member (A) up and inwardly of the lateral body side to increase the amount of the band member between the second free end and the idler roller and to shorten the amount of the band member between the first free end and the idler roller, thereby moving the bucket form its loading to its discharge position, and (B) outwardly of the lateral body side and down to shorten the amount of the band member between the second free end and the idler roller and to increase the amount of the band member between the first free end and the idler roller, thereby moving the bucket from its discharge to its loading position.

2. Apparatus as in claim 1, wherein:

the pivotal member is a portion of the cover so that opening and closing the cover elevates and lowers the bucket.

3. An apparatus for collecting recyclable material comprising:

(a) a truck body mountable to a truck frame and extending longitudinally between a forward end and a rearward end, the body enclosing a material-receiving volume;

(b) a horizontal wall within the volume which divides the volume into separate upper and lower material-recovering compartments for receiving recyclable materials of different types, a first type of recyclable material comprising commingled glass, plastic and aluminum being received in the upper compartment, and a second type comprising newsprint and other paper being received in the lower compartment, the wall preventing commingling thereof while the materials are within the volume, each compartment having a material-discharge opening at the rearward end of the body;

(c) a first selectively openable discharge door which is normally closed to cover the discharge opening of the lower compartment;

(d) a second selectively openable discharge door which is normally closed to cover both discharge openings and the closed first discharge door, the second discharge door being located at the rear of the body and when closed forming a wall thereof so that, with the discharge doors closed, the upper compartment includes a rearward portion which is defined between the discharge doors;

(e) means for opening the second discharge door to permit the discharge of material from the upper compartment via its discharge opening while the closed first discharge door prevents the discharge of material from the lower compartment via its discharge opening; and (f) means for opening the first discharge door while the second discharge door is open to permit the discharge of material from the lower compartment via its discharge door, the discharge doors and the opening means also permitting discharge of the materials without substantial commingling thereof.

4. Apparatus as in claim 3, which further comprises:

means in each compartment for compacting material therein by applying force to the material toward the rear of the body and toward and against the closing discharge doors.

5. Apparatus as in claim 3, which further comprises:

means in each compartment for compacting material therein by applying force to the material toward the rear of the body and toward and against the closed discharge doors; and means for operating the compacting means so that when one compacting means applies force to the material in one compartment, the other compacting means does not apply force to the material in the other compartment.

6. Apparatus as in claim 5, which further comprises:

means in the upper compartment for inducing glass material to gravitate to a lower region of the upper compartment near the wall as the compacting means in the upper compartment moves and compacts material therein.

7. Apparatus as in claim 6, wherein:

the inducing means includes a step, a lower portion of the step being rearward of an upper portion of the step, whereby the glass tends to fall below the plastic and aluminum as the compacting means moves the material in the first compartment over the step.

8. Apparatus as in claim 3, which further comprises:

means for mounting the body to the truck for pivoting of the body on the truck so as to elevate the forward end of the body as the rearward end of the body is lowered, so that, as the discharge doors are opened, the material falls a relatively short distance to the ground.

9. Apparatus as in claim 3, wherein:

the second discharge door has a contour which is outwardly bulged.

10. Apparatus as in claim 9, wherein:

the first discharge door is outwardly bulged.

11. An apparatus for collecting recyclable material, comprising:

(a) a truck body mountable to a truck frame and extending longitudinally between a forward end and a rearward end, the body enclosing a material-receiving volume;

(b) a horizontal wall within the volume which divides the volume into separate upper and lower material-recovering compartments for receiving recyclable materials of different types, a first type of recyclable material comprising commingled glass, plastic and aluminum being received in the upper compartment, and a second type comprising newsprint and other paper being received in the lower compartment, the wall preventing commingling thereof while the materials are within the volume, each compartment having a material-discharge opening at the rearward end of the body;

(c) a first selectively openable discharge door which is normally closed to cover the discharge opening of the lower compartment;

(d) a second selectively openable discharge door which is normally closed to cover both discharge openings and the closed first discharge door;

(e) means for opening the second discharge door to permit the discharge of material from the upper compartment via its discharge opening while the closed first discharge door prevents the discharge of material from the lower compartment via its discharge opening;

(f) means for opening the first discharge door while the second discharge door is open to permit the discharge of material from the lower compartment via its discharge door; and (g) means for mounting the body to the truck for pivoting of the body on the truck so as to elevate the forward end of the body as the rearward end of the body is lowered, so that, as the discharge doors are opened, the material falls a relatively short distance, this relatively short distance being sufficiently small to minimize the breakage of glass.

12. An apparatus for collecting and transporting recyclable waste material, comprising:

(a) a body mountable to a vehicle and extending longitudinally between a forward end and a rearward end, the body enclosing a material-receiving volume;

(b) a horizontal wall within the body forming separated upper and lower material-receiving compartments;

(c) first and second longitudinally-spaced loading openings at the top of the body, the first loading opening being in continuous communication with only the lower compartment, and the second loading opening being positioned rearward of said first loading opening and in continuous communication with only the upper compartment;

(d) a first door for closing the rear of the lower compartment;

(e) a second door for closing the rearward end of the body and the upper compartment, the second door when closed overlying and being spaced from the first door to define a vertical rearward continuation of the upper compartment;

(f) a bucket vertically movable along the exterior lateral side of the body between a lower loading position at the bottom of the body and an elevated discharge position at the top of the body, the bucket having separated bins for receiving material, each bin being aligned with one of the loading openings when the bucket is in the discharge position to dump material into one of the compartments;

(g) a first moveable compactor for compacting and moving only material received within said lower compartment via said first loading opening, said first compactor being positioned in non-interfering position with said second loading opening; and, (h) a second moveable compactor for compacting and moving only material received within said upper compartment via said second loading opening, said second compactor being positioned rearward of and in non-interfacing position with said first loading opening.

13. The waste collecting and transporting apparatus of claim 12, wherein said first and second compactors are extendable and retractable, and can be actuated either separately as well as together with each other.

14. The waste collecting and transporting apparatus of claim 12, further comprising a vertical recess formed in the side of the body and located adjacent the forward end of the body, said bucket being at least partially contained in and vertically movable in said recess.

15. The waste collecting and transporting apparatus of claim 14, wherein the bucket is substantially contained in said recess.

16. The waste collecting and transporting apparatus of claim 14, wherein the bucket does not substantially protrude from said recess laterally of the body in its lower position.

17. The waste collecting and transporting apparatus of claim 14, wherein the bucket does not substantially protrude from said recess laterally of the body in any position thereof.

18. The waste collecting and transporting apparatus of claim 12, wherein the upper compartment receives commingled glass, plastic and metal materials from one bin and the lower compartment receives paper materials from the other bin, whereby breakage of the glass is reduced by virtue of the short travel from the elevated discharge position of the bucket to the upper compartment.

19. The waste collecting and transporting apparatus of claim 12, further comprising a vertical step formed in the upper compartment at a location below and rearward of said second compactor when fully retracted.

20. The waste collecting and transporting apparatus of claim 12, wherein said first and second compactors are operatively associated such that when one is extending the other is retracting.

21. A method for collecting and transporting recyclable waste material including at least paper and commingled plastic, metal and glass, said method comprising the steps of:

(a) segregating at least a portion of said paper from said commingled plastic, metal and glass;

(b) placing said segregated paper into one compartment of a vertically movable bucket operatively associated with a waste transport vehicle, placing said commingled plastic, metal and glass into another compartment of said bucket; and conveying said bucket containing said segregated recyclable waste materials to an elevated position;

(c) discharging said recyclable waste materials from said bucket into a body carried by said vehicle, said segregated paper being loaded into a lower generally horizontal compartment of said body through a first vertical opening, and said commingled plastic, metal and glass being loaded into an upper generally horizontal compartment of said body through a second vertical opening located rearward of said first vertical opening;

(d) compacting said paper within said lower body compartment to move said paper horizontally rearward toward a closed lower compartment discharge door;

(e) compacting said commingled plastic, metal and glass within said upper body compartment to move said commingled plastic, metal and glass first horizontally rearward and then downward toward a closed upper compartment discharge door, said upper discharge door being positioned rearwardly of and overlying said lower discharge door to thereby define a rearward extension of said upper compartment located rearward of said lower compartment;

(f) repeating steps (a) through (e) to maximize the load of recyclable waste materials carried by said vehicle;

(g) discharging said commingled plastic, metal and glass from said upper compartment to a first waste collection location; and, (h) thereafter discharging said paper from said lower compartment to a second waste collection location.

22. The method of claim 21, wherein said discharging step (g) is accomplished by first opening said upper discharge door and then tilting said body, and said discharging step (h) is next accomplished by opening said upper discharge door and then tilting said body.

23. The method of claim 22, wherein the compacting of said paper and the compacting of said commingled plastic, metal and glass are performed alternately such that only one of said compacting steps is performed at one time.

* * * * *

UNITED STATES PATENT AND TRADEMARK OFFICE

CERTIFICATE OF CORRECTION

PATENT NO. : 5,288,196
DATED : February 22, 1994
INVENTOR(S) : Larry D. Horning, et. al.

It is certified that error appears in the above-indentified patent and that said Letters Patent is hereby corrected as shown below:

Column 4, line 16, "fail" should be "fall"
Column 7, line 8, "12y" should be "12r"

Column 12, line 6, "AU" should be "all"
Column 13, line 16, "form" should be "from"
Column 14, line 51, "recovering" should be "receiving"
Column 15, line 58, "interfacing" should be "interfering"

Signed and Sealed this

Second Day of August, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,288,196

DATED : February 22, 1994

INVENTOR(S) : Larry D. Horning, et. al.

It is certified that error appears in the above-indentified patent and that said Letters Patent is hereby corrected as shown below:

Column 2, line 16, delete space between "f" and "rom", should be -- "from"
Column 6, line 27, "depleted" should read -- "depicted"
Column 6, line 40, "depleted" should read -- "depicted"
Column 7, line 52 "Center" should read -- "center"
Column 12, line 27, "compartmenting" should read -- "compacting"
Column 12, line 28, "compartmenting" should read -- "compacting"
Column 18, line 2, "upper" should read -- "lower"

Signed and Sealed this

Sixth Day of June, 1995

*Attest:*

*Attesting Officer*

BRUCE LEHMAN

*Commissioner of Patents and Trademarks*